US005203301A

United States Patent [19]

Maier et al.

[11] Patent Number: 5,203,301

[45] Date of Patent: Apr. 20, 1993

[54] CONTROL CAPSULE FOR A CENTRIFUGAL SPEED GOVERNOR

[75] Inventors: Sieghart Maier, Gerlingen; Guenther Koch, Zweibruecken, both of Fed. Rep. of Germany

[73] Assignee: Robert Bosch GmbH, Stuttgart, Fed. Rep. of Germany

[21] Appl. No.: 880,270

[22] Filed: May 8, 1992

[30] Foreign Application Priority Data

May 10, 1991 [DE] Fed. Rep. of Germany ..... 4115301

[51] Int. Cl.[5] ..... F02D 31/00

[52] U.S. Cl. ..... 123/373

[58] Field of Search ..... 123/364, 365, 372, 373, 123/368

[56] References Cited

U.S. PATENT DOCUMENTS

| | | | |
|---|---|---|---|
| 1,928,476 | 9/1933 | Baur et al. | 123/373 |
| 2,096,203 | 10/1937 | Schnurle et al. | 123/373 |
| 2,259,693 | 10/1941 | Hogeman | 123/373 |
| 3,426,739 | 2/1969 | Bailey et al. | 123/373 |
| 4,132,206 | 1/1979 | Straubel et al. | 123/374 |
| 4,164,925 | 8/1979 | Maier et al. . | |
| 4,258,675 | 3/1981 | Volz et al. | 123/373 |
| 4,308,833 | 1/1982 | Makino | 123/373 |
| 4,409,941 | 10/1983 | Haubenhofer | 123/373 |
| 4,479,474 | 10/1984 | Djoedjevic et al. | 123/373 |
| 4,694,795 | 9/1987 | Pruneda | 123/373 |
| 4,782,804 | 11/1988 | Lehmann | 123/372 |

FOREIGN PATENT DOCUMENTS

| | | | |
|---|---|---|---|
| 1947631 | 6/1970 | Fed. Rep. of Germany | 123/373 |
| 2328407 | 12/1973 | Fed. Rep. of Germany | 123/373 |
| 1307994 | 9/1962 | France | 123/373 |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A centrifugal speed governor including a control capsule. The control capsule includes a face-end part which is interchangeable and always has the same thickness (d). To enable making adjustments and to compensate for tolerances, the face-end has a set of indentations that can be made with various heights, in such a way that a middle part of the face-end protrudes outward, as viewed from a direction of the control capsule.

2 Claims, 1 Drawing Sheet

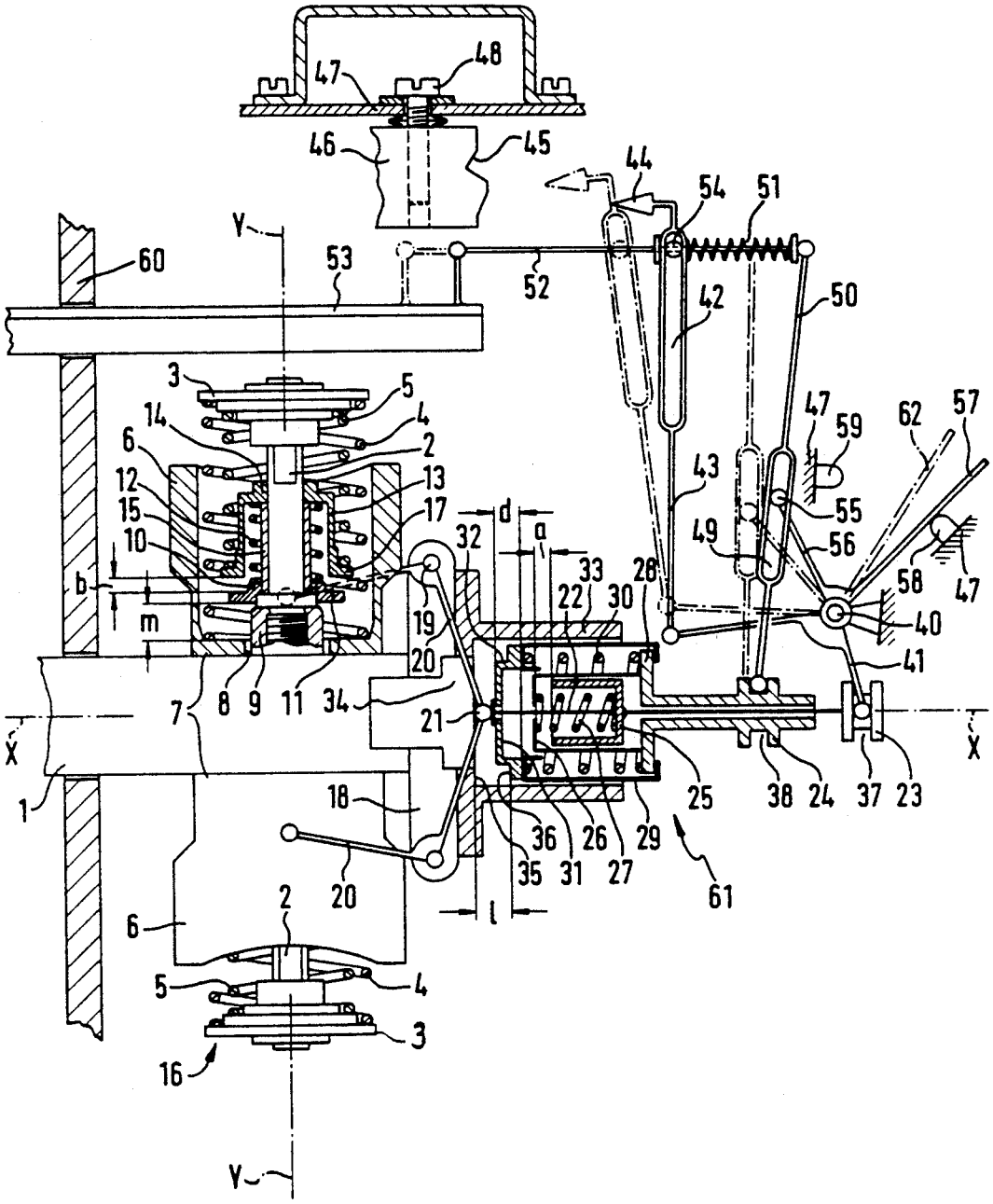
48
47
46
45
44
54
51
Y
60
53
52
42
50
3
5
14
4
6
2
12
13
15
17
10
d
a
32
33
28
22
30
b
m
19
20
34
21
7
8
9
11
X
1
18
25
38
24
37
23
36
26
29
35
31
27
61
20
l
2
6
5
4
3
16
Y
47
59
62
57
43
55
49
56
58
47
40
41

CONTROL CAPSULE FOR A CENTRIFUGAL SPEED GOVERNOR

COPENDING APPLICATION

This application is copending with application R.24369 of the same assignee.

BACKGROUND OF THE INVENTION

The invention relates to a control capsule for a centrifugal speed governor as defined hereinafter.

A centrifugal speed governor of this kind is used in fuel-injected internal combustion engines.

A centrifugal speed, or rpm, governor has the basic task of maintaining an allowable maximum rpm or a constant rpm in an internal combustion engine. Moreover, it has control tasks to perform, among them what is called torque control—that is, varying the fuel quantity for full-load operation as a function of the rpm; this enables optimal utilization of the torque generated in the engine and is based on the greatest quantity of fuel pumped in the loadable range of the engine and combusted without smoke; see Bosch, Kraftfahrtechnisches Taschenbuch [Automotive Handbook], 20th Edition, pp. 384–386, VDI-Verlag Düsseldorf, 1987.

German Patent 26 56 261 discloses a centrifugal speed governor in which the adjustments of the flyweights as a consequence of the rotational speed of the engine are transmitted, via a governor adjusting element including a control capsule and via a lever mechanism in combination with a correction element, to a supply quantity adjusting member that regulates the fuel injection quantity. It is important that the control capsule rest on the shoulder of a guide sleeve when the adaptation process begins, which happens with the aid of the correction element, which comprises a feeler prong and a stop curve track. This was attainable previously only at considerable expenditure, because of unavoidable tolerances in the centrifugal speed governor; that is, the governor adjusting element sometimes had to be dismantled repeatedly and corresponding adjustments of individual parts of the governor adjusting element relative to one another had to be done. Moreover, under some circumstances control capsules with variably thick bottoms on the face end toward the shoulder of the guide sleeve are necessary.

OBJECT AND SUMMARY OF THE INVENTION

The control capsule of the invention has an advantage over the known versions that in a simple manner it can compensate for tolerances that are dictated either by an incorrect position of repose of the flyweights, by the transmission mechanism from the flyweights to the governor adjusting element, and an improper spacing of the bottom on the face end of the control capsule itself from the shoulder in the guide sleeve. While previously it was usual to use control capsules with variously thick bottoms on the face end, and the internal structure of the governor adjusting element always had to be adapted to whichever thickness of the face-end bottom was used, the version according to the invention has the advantage that face-end bottoms of identical thickness with different step heights can be produced in large quantities from the outset, and that a face-end bottom with a suitable step height is used to suit the particular tolerance situation. This simplifies not only the adjustment process but also the manufacturing process.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing schematically shows a centrifugal speed governor, partly in section and partly in a front view.

DESCRIPTION OF THE PREFERRED EMBODIMENT

Bolts 2 are secured indirectly, substantially at right angles to the geometric and rotational axis X—X, on a drive shaft 1, and are provided with spring plates 3 on their free ends. Coaxial helical springs 4, 5 are supported by their corresponding ends against the spring plates 3; of these springs, the outer helical springs 4 are called idling springs and the inner springs are called cutoff governor springs 5. Hollow-cylindrical flyweights 6 with bottoms 7 oriented toward the drive shaft 1 are disposed on the bolts 2 such that they can be adjusted counter to the direction of a common axis Y—Y; the upper one of these flyweights in the drawing is shown in section, and the lower one is shown in a front view. The axial section of the upper flyweight 6 shows that the bottom 7 of the two identically embodied flyweights 6 has a hole 8, through which the bolt 2 with its base 9 of larger diameter protrudes. Resting on the base 9 is a second spring plate 10, when the centrifugal speed governor is in repose. An adaptation spring 12 is supported by one end against the spring plate 10, which is provided with a collar 11; over a substantial portion of its length, the adaptation spring is located in a capsule 13, which likewise slides on the bolt 2, and by its other end the adaptation spring 12 is supported against the sleeve part 14 of the capsule. On its open end toward the spring plate 10, the capsule 13 has a flange 17, which on the one hand can serve as a bearing surface for the spring plate 10 and on the other serves to support the cutoff governor spring 5. Between the adaptation spring 12 and the spring plate 10 on the one hand and the bolt 2 on the other, there is a socket 15 that participates in the motions of the capsule 13. The idling spring 4 is supported by its end toward the driveshaft 1 against the bottom 7 of the flyweight 6. In the position of repose of the centrifugal speed governor, shown, the flyweights 6 rest by the action of the idling springs 4 indirectly on the drive shaft 1 with their bottom 7, and the spring plate 10 is pressed against the base 9 by the cutoff governor spring 5 and the adaptation spring 12. The parts surrounding the bolt 2 are disposed with it, coaxially with the axis Y—Y, and form its measuring mechanism 16.

A hub 18 is indirectly connected to the drive shaft 1 and is provided with bearings 19 for bell cranks 20, which are pivotably connected on the one hand to the flyweights 6 and on the other, at a common pivot point 21, to a connecting part 22 of an adaptation sleeve 23, in which the connecting part 22 is supported slidingly in a governor sleeve 24 and is displaceable parallel to the axis X—X. The adaptation sleeve 23 and the governor sleeve 24 are each provided with a respective support part 25 and 26, against which an adaptation control spring 27 is supported. The governor sleeve 24 also has a shoulder 28, which like the support parts 25 and 26 is located in a control capsule 29. The governor sleeve 24 is supported with its support part 26 and its shoulder 28 in the control capsule 29, such that it is displaceable parallel to the axis X—X, counter to the action of a deflection spring 30. The deflection spring 30 is supported at one end against the shoulder 28 and at the other against the face-end bottom 31 of the control capsule 29. The adaptation sleeve connecting part 22 having the pivot point 21 protrudes through the face-end bottom 31. The face-end bottom 31 has a thickness d and is provided, beginning where the adaptation sleeve connecting part 22 passes through it with a radially extending step 32. For different step heights, different elements 31 with different step heights can be substituted for the element 31 and the step 32; the step height depends on the aforementioned tolerances. The control capsule 29 slides axially in a guide socket 33, whose interior is continued in the central part of the hub 18; the socket 33 is provided with a shoulder 35, as a stop face for the peripheral part 36 of the face-end bottom 31.

In the functional position shown of the centrifugal speed governor, the shoulder 35 (annular stop) and the peripheral part 36 are spaced apart by a distance l; the support parts 25 and 26 are spaced apart by an axial distance a; the bottom 7 and the collar 11 are spaced apart by a distance m; and the collar 11 and the flange 17 are spaced apart from one another by a distance b. In that case, a equals or is less than b, if l equals or is less than m. The distance l corresponds to the idling interval; thus, like the spacing a, it is the product of the interaction of the forces of the adaptation control spring 2 and the deflection spring 30. In the same way, the distances m and b are established on the basis of the forces of the helical springs 4, 5 and 12. The adaptation sleeve 23, the governor sleeve 24 and the control capsule 29, with the components contained in them, form the governor adjusting element 61, which is disposed coaxially to the axis X—X. They are provided with annular grooves 37, 38 at the ends where the adaptation sleeve 23 and the governor sleeve 24 are not located in the control capsule 29.

One end of the two-armed lever 41 is supported on a shaft 40 attached to the housing and engages the annular groove 37; its other end is pivotably connected to an adaptation lever 43 provided with a connecting link guide slot 42. On the still-free end of the adaptation lever 43 is a feeler protrusion 44, which cooperates with a stop curve track 45, which successively includes the various control paths for starting, aspiration, adaptation and maximum-speed governing. The stop curve track 45 and its carrier 46 are disposed so as to be adjustable, by the aid of a set screw 48 supported in the housing 47, which is merely suggested in the drawing.

One end of a governor lever 50, provided with a connecting link guide slot 49, engages the annular groove 38. Its other end is pivotably connected to a linkage 52 provided with a force storing means 51; the other end of the linkage is connected to a governor rod 53, and a sliding block 54 is secured on the linkage and engages the connecting link guide slot 42 of the adaptation lever 43. The force storing means 51 applies a force on the unused travel of the governor rod 53 and the adaptation lever. Sliding in the slot 49 is a sliding block 55, which is attached to one end of a control lever 56, which is firmly connected to an adjusting lever 57 and is pivotably about the shaft 40, supported on the housing 47, between two stops attached to the housing, that is, the cutoff stop 58 and the fullload stop 59.

The drive shaft 1 and the governor rod 53 protrude through part of the injection pump housing 60 to the inside of the centrifugal governor.

In the position shown, the centrifugal speed governor is in repose; the drive shaft 1 is not turning, and the adjusting lever 57 rests on the cutoff stop 58. If the engine is started and is idling, then the flyweights 6 move outward along the bolts 2 by an amount that correspondingly compresses the idling springs 4, and via the bell cranks 20 the control capsule 29 moves to the left by the same amount, so that the bottom 7 approaches the spring plate 10 and the face-end bottom 31 of the shoulder 35 by the same amount, or in other words the corresponding distances l and m are reduced by the same amount. Once the adjusting lever 57 has moved from the cutoff stop 58 to the idling position 62, neither the components in the control capsule 29 nor the capsule 13 changes position with respect to the spring plate 10.

Now, once the adjusting lever 57 moves against the full-load stop 59, the sliding block 55 moves along a circular arc around the shaft 40, presses the governor lever 50 to the left, and defines an instantaneous pivot point for the governor lever 50. The idling interval is over with; the rotation of the drive shaft 1 is accelerated, and the flyweight bottom 7 presses against the spring plate 10; this is on the condition that the spacings are l=m and a=b. In addition, the bell cranks 20 and with them the pivot point 21 are moved in such a way that the peripheral part 36 presses against the shoulder 35. The deflection spring 30 acts upon the governor lever 50, which as a result is pivoted about the sliding block 55 and moves the linkage 52 to the left. Since the adaptation sleeve 23 is also moved to the left, the two-armed lever 41 swivels clockwise, and hence the adaptation lever 43 moves upward. The feeler protrusion 44 moves along the stop curve track 45 in this process. While at the beginning of torque control the bottom 7 rests on the spring plate 10 and the peripheral part 36 rests on the shoulder 35, and the end of the negative and positive torque control, which are effected by the adaptation spring 12 in the capsule 13 in cooperation with the stop curve track 45, the flange 17 presses against the collar 11 and the support part 25 of the adaptation sleeve 23 presses against the support part 26 of the governor sleeve 24. Correspondingly, the spring forces of the adaptation spring 12 and adaptation control spring 27, which has thus attained its maximum tension, are overcome. From then on, the adaptation sleeve 23 and the governor sleeve 24 operate together once again. With the onset of the maximum-speed control, the feeler protrusion 44 moves away from the stop curve track 45 again, and the helical springs 4, 5, 12 in the measurement mechanism 16 and the helical spring 30 in the governor adjusting element 61 or in the control capsule 29 are compressed to a maximum extent; the governor rod 53 moves in the stop direction.

As a result of the invention it is possible to manufacture face-end bottoms 31 in the form of independent components for the control capsule 29, with increasing or decreasing heights for the set of steps 32, and to accommodate the production tolerances accordingly. Since the face-end bottoms 31 always have the same thickness d, then even though the height of the idling interval l changes, the location a of the support parts 26 and 25 and thus the spacing a and the spring biasing of the adaptation control spring 27 are all maintained.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A control capsule for a centrifugal speed governor, which is disposed axially adjustably in a guide socket (33) and includes a governor sleeve (24) which includes one end (28) supported on said control capsule, and an adaptation sleeve (23) positioned relative to said governor sleeve, said control capsule includes a first support part (25) and a second support part (26) which are movable relative to each other within said capsule (29) and which are supported against one another by means of a helical spring (27) and an adaptation sleeve connecting part (22), said adaptation sleeve connecting part (22) includes one portion which extends through the control capsule (29) and a portion which extends through the governor sleeve (24) one end of said adaptation sleeve connecting part is pivotably connected to flyweights (6) of the centrifugal speed governor with the opposite end which passes through the governor sleeve connected to the adaptation sleeve (23), said control capsule includes a face-end (36) including a face-end bottom (31), and the guide socket (33), includes an annular stop (35) located axially adjacent the face-end (36) of the control capsule (29), the face-end bottom (31) of the control capsule (29) is provided with a stp (32) that protrudes radially from the annular stop (35); the face-end bottom (31) has a constant thickness (d); and the position of the face-end (36) of the face-end bottom (31) that comes to rest on the annular stop (35) is variable within a thickness range (d), depending on the height of the step (32).

2. A control capsule as defined by claim 1, in which the face-end bottom (31) of the control capsule (29) is an independent, interchangeable component.

* * * * *